US006648140B2

(12) United States Patent
Petricca

(10) Patent No.: US 6,648,140 B2
(45) Date of Patent: Nov. 18, 2003

(54) CONTAINER FOR SHAVING CARTRIDGE OR OTHER STORED ITEM

(75) Inventor: John D. Petricca, Leominster, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 10/325,364

(22) Filed: Dec. 19, 2002

(65) Prior Publication Data

US 2003/0089631 A1 May 15, 2003

Related U.S. Application Data

(62) Division of application No. 09/364,242, filed on Jul. 29, 1999, now Pat. No. 6,499,595.

(51) Int. Cl.[7] ..... B65D 83/10
(52) U.S. Cl. ..... 206/356; 220/270; 220/359.2
(58) Field of Search ..... 206/352–356, 206/467, 471, 528–534, 538; 220/260, 265, 266, 269, 270, 271, 272, 273, 359.1–359.4, 839, 841

(56) References Cited

U.S. PATENT DOCUMENTS

| | | | |
|---|---|---|---|
| 1,489,379 | A | 4/1924 | Zeller |
| D90,931 | S | 10/1933 | Wanders |
| 1,986,230 | A | 1/1935 | Talbot |
| 2,075,178 | A | 3/1937 | Copeman |
| 2,138,241 | A | 11/1938 | Koch et al. |
| 2,194,281 | A | 3/1940 | Gustafson |
| 2,518,423 | A | 8/1950 | Jenett |
| 2,822,916 | A | 2/1958 | Wark et al. |
| 2,849,109 | A | 8/1958 | Rommel |
| 3,045,812 | A | 7/1962 | Randolph |
| 3,084,791 | A | 4/1963 | Hawley et al. |
| 3,095,965 | A | 7/1963 | Stahl et al. |
| 3,367,482 | A | 2/1968 | Samsing |

(List continued on next page.)

FOREIGN PATENT DOCUMENTS

| | | |
|---|---|---|
| AU | B-75184/91 | 5/1991 |
| CA | 926760 | 5/1973 |
| DE | 197 51 428 A1 | 5/1998 |
| EP | 0 299 571 | 1/1989 |
| EP | 0 548785 A1 | 6/1993 |
| FR | 2 714 031 | 6/1995 |
| HU | 218 851 | 12/2000 |
| WO | WO 94/14677 | 7/1994 |

OTHER PUBLICATIONS

Standard Test Method for Block Resistance of Paper and Paperboard[1], pp. 241–243.
Standard Method of Test for Crease Retention of Wrapping Paper; pp. 1003–1005.
Abstract of HU 9802659, Jan. 12, 1999.

*Primary Examiner*—Luan K. Bui
(74) *Attorney, Agent, or Firm*—Fish & Richardson P.C.

(57) ABSTRACT

Sealed package that includes a formed plastic container, a shaving cartridge (or other stored unit) in a storage region in the container, and a removable film that covers and is sealed to a sealing surface around an entrance to the storage region. Side walls of the container have retaining structure that protrudes inward and retains the shaving cartridge (or other stored unit). The container has a lip adjacent to and extending from a side wall of the container at an entrance to the storage region to space a user's finger or thumb from the entrance during removal of the cartridge. The removable film has deadfold characteristics which facilitate removal of the cartridge when the film is still partially connected at the rear of the container. A plastic tab is attached to a portion of the film extending beyond the sealing surface of the container to initiate peeling of the film from the sealing surface. The plastic tab is spaced from the formed plastic container by a gap.

18 Claims, 8 Drawing Sheets

U.S. PATENT DOCUMENTS 3,559,865 A 2/1971 Field
D227,083 S 6/1973 Anderson et al.
3,760,938 A 9/1973 Ferrier, Jr.
3,933,245 A 1/1976 Mullen
3,964,670 A 6/1976 Amneus
3,970,194 A 7/1976 Iten
3,972,417 A 8/1976 Iten et al.
4,095,691 A 6/1978 Iten
RE29,937 E 3/1979 Mahaffy et al.
D251,896 S 5/1979 Nissen
D253,040 S 10/1979 Fournier et al.
D253,167 S 10/1979 Fournier et al.
4,285,428 A 8/1981 Beddall et al.
4,452,842 A 6/1984 Borges et al.
4,539,259 A 9/1985 Zuscik
4,574,104 A 3/1986 Aishima et al.
4,656,068 A 4/1987 Raines
4,659,408 A 4/1987 Redding
4,701,359 A 10/1987 Akao
4,742,909 A 5/1988 Apprille, Jr. et al.
D296,191 S 6/1988 Yoshida et al.
4,807,745 A 2/1989 Langley et al.
4,863,036 A 9/1989 Heijenga
D306,216 S 2/1990 Gray
4,943,780 A 7/1990 Redding
4,946,038 A 8/1990 Eaton
4,955,530 A 9/1990 Rigby et al.
D316,962 S 5/1991 Gray
D320,342 S 10/1991 Gray
5,082,112 A 1/1992 Dunklee
5,092,469 A 3/1992 Takata et al.
5,096,084 A * 3/1992 Wells ..... 220/841
5,105,942 A 4/1992 van Veen et al.
5,125,529 A 6/1992 Torterotot
5,131,539 A 7/1992 Karita et al.
5,134,775 A 8/1992 Althaus et al.
5,144,942 A 9/1992 Decarie et al.
5,176,258 A 1/1993 Antal
5,228,580 A 7/1993 Grange
5,230,948 A 7/1993 Preiss et al.
D342,853 S 1/1994 Grange
D345,233 S 3/1994 Gray
5,314,749 A 5/1994 Shah
5,346,069 A * 9/1994 Intini ..... 206/531
5,407,066 A 4/1995 Grange
5,429,241 A 7/1995 Althaus
5,506,036 A 4/1996 Bergerioux
5,518,114 A 5/1996 Kohring et al.
5,636,442 A 6/1997 Wain
5,662,221 A 9/1997 Abidin et al.
5,725,962 A 3/1998 Bader et al.
5,772,031 A 6/1998 Landis
5,830,545 A 11/1998 Frisk
5,857,582 A 1/1999 Schulz
5,868,253 A 2/1999 Kruegger et al.
5,879,028 A 3/1999 Benoit
5,885,673 A 3/1999 Light et al.
D407,851 S 4/1999 Shurtleff
5,891,555 A 4/1999 O'Brien
5,950,830 A 9/1999 Trigger
6,135,304 A * 10/2000 Wyslotsky ..... 220/359.1
6,413,599 B1 7/2002 Petricca et al.

* cited by examiner

FIG. 12
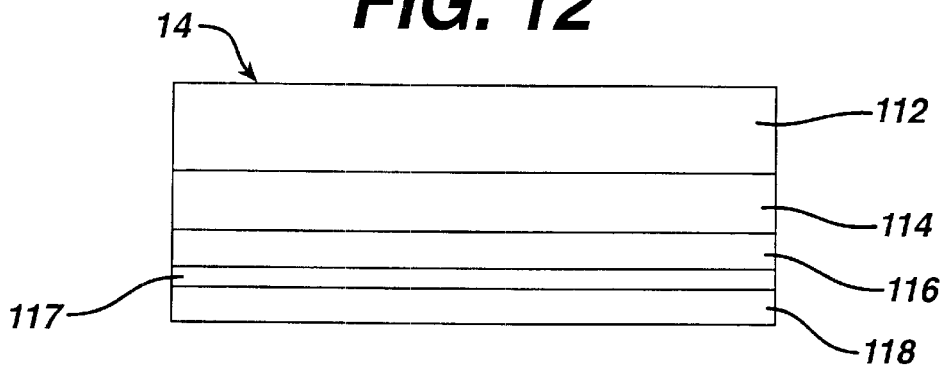
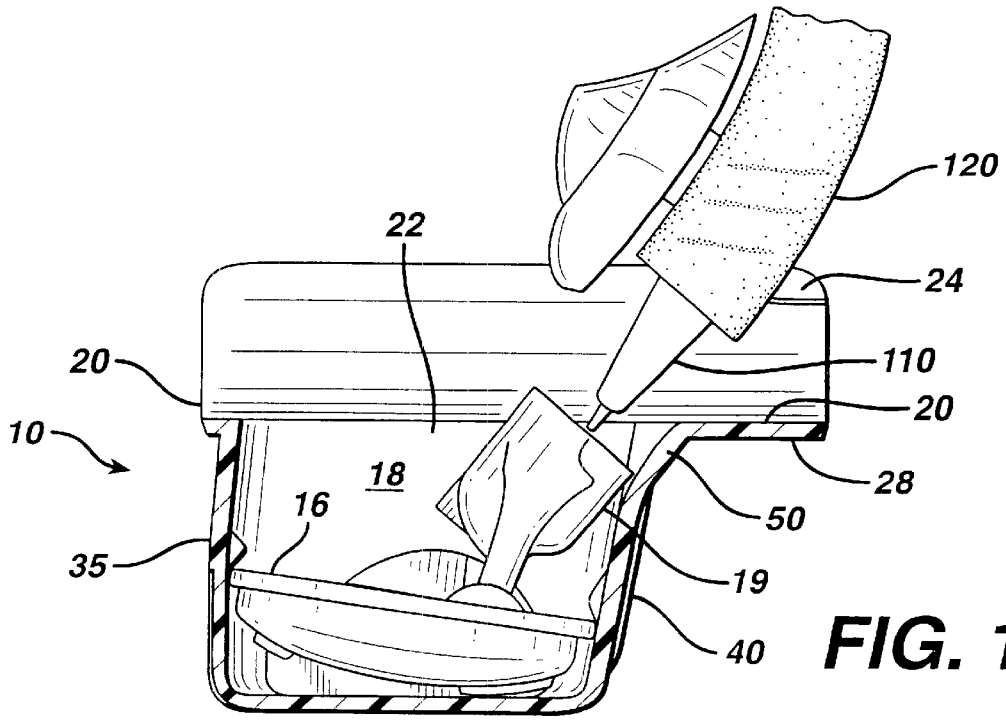
FIG. 13
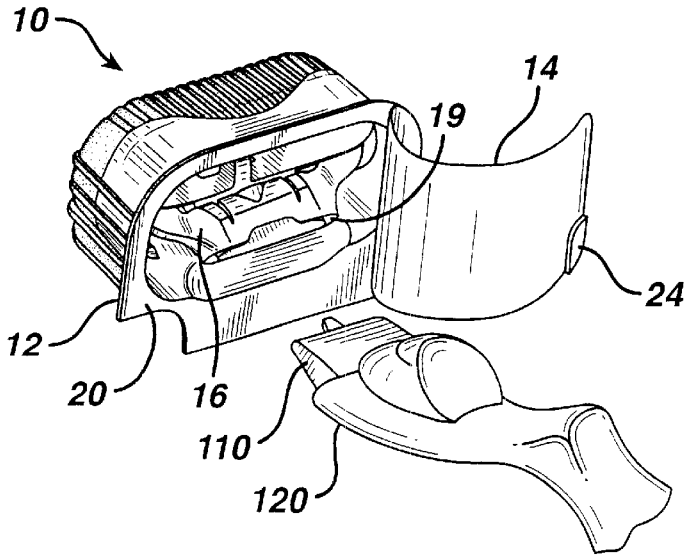
FIG. 14

CONTAINER FOR SHAVING CARTRIDGE OR OTHER STORED ITEM

CROSS REFERENCE TO RELATED APPLICATIONS

This is a divisional of U.S. application Ser. No. 09/364,242, filed Jul. 29, 1999, U.S. Pat. No. 6,499,595.

This application is related to an application entitled "Storage Device for Shaving Razor, Cartridges or Other Stored Items," U.S. Ser. No. 09/364,240, filed Jul. 29, 1999, U.S. Pat. No. 6,499,595, which is hereby incorporated by reference.

BACKGROUND OF THE INVENTION

The invention relates to containers for storing items such as shaving cartridges.

Shaving cartridges are typically sold in plastic dispensers containing a plurality of shaving cartridges located in respective sections of the container.

APPLICANTS' STATEMENT OF ACKNOWLEDGED PRIOR ART

It is known in the art of packaging snacks and condiments to have a rectangular formed plastic container generally in the shape of an open box with a peripheral rim, covered by a platic foil sealed around the rim, and a pull tab which is then formed by a slitting knife shearing one corner of the rim diagonally such that the triangular tab remains attached to the sealing foil with no appreciable space between the triangular tab and the adjacent portion of the rim. For example, such packages have been used to package snacks that have been available in the United States under the trade designation "Phileas Fogg". Such prior art package is depicted in the accompanying FIGS. 10–11 labeled "prior art." Applicants understand the plastic container 101 is formed of a food-compatible thermoplastic with a rim 102 formed around the four sides (the rim being generally the same width on opposite sides, but of slightly different widths on adjacent sides), has a plastic covering film 104 sealed around the rim, the film being metallic-colored (believed to be by vacuum deposition) on the underside and printed with the product information on the outside, and the pull tab 106 remaining adhered to the film when it is peeled back. Applicants have recognized that when the plastic film is peeled back from the plastic container but not completetly removed therefrom and then let go, the film falls away from the position shown in FIG. 11 back to block the opening, and thus completely lacks any "deadfold" capability to leave the opening accessible as that term is discussed hereinbelow. It is know, however, that plastic food pack films have moisture and gas barrier properties to protect the product from becoming stale.

The acknowledged prior art also includes bendable metal foil used to cover plastic containers for patty-sized portions of butter, or similar packages for condiments or preserves such as have been available in the United States under the name Knotts Berry Farm Foods, Inc. (Placentia, Calif.); these containers also have a corner pull tab that has been provided by slitting a rim portion. The laminate cover foil is understood to be thin metal foil coated outside with plastic (with printed graphics) and having a heat seal adhesive under layer. The plastic coating merely provides moisture and gas barrier properties. The foil of these containers can be peeled back but must be made of metal so as to permit being permanently deformed.

The acknowledged prior art further includes a polyester coated paper layer with a sealant under layer such as hot melt adhesive, such as used in 6-pack individual serving yogurt containers such as believed to have been available in the United States under the name Yoplait. The polyester helps one-piece removal. The paper has some minimal ability to remain folded back, but lacks moisture barrier properties because it is absorbent.

SUMMARY OF THE INVENTION

In one aspect, the invention features, in general, a sealed package that includes a formed plastic container, a shaving cartridge (or other stored unit) in a storage region in the container, and a removable film that covers and is sealed to a sealing surface around an entrance to the storage region. Side walls of the container have retaining structure that protrudes inward and retains the shaving cartridge (or other stored unit).

In another aspect, the invention features, in general, a sealed package that contains a shaving cartridge in a formed plastic container that is sealed by a removable film. The container has a lip adjacent to and extending from a side wall of the container at an entrance the storage region to space a user's finger or thumb from the entrance during removal of the cartridge.

In another aspect, the invention features, in general, a sealed package that contains a shaving cartridge in a formed plastic container that is sealed by a removable film. The film has deadfold characteristics which facilitate removal of the cartridge when the film is still partially connected at the rear of the container.

In another aspect, the invention features, in general, a sealed package that contains a stored unit in a formed plastic container that is sealed by a removable film. A plastic tab is attached to a portion of the film extending beyond the sealing surface of the container to initiate peeling of the film from the sealing surface. The plastic tab is spaced from the formed plastic container by a gap.

Particular embodiments of the invention may include one or more of the following features. The blades of the cartridge face away from the entrance to the storage region. The container has a ramp structure that leads from the lip on the container to the cartridge in the storage region. The container has support members on the bottom wall that support the cartridge in a desired orientation; the support members have a curved surface that matches the upper surface profile of the cartridge. The cartridge retaining structures on the side walls of the container have inclined surfaces facing the entrance and the bottom wall. The container is transparent. The container has a plurality of protruding finger gripping ridges on one or more exterior surfaces; the ridges on some surfaces have an indented profile to accommodate a user's fingers. The plastic tab connected to the removable film has a gripping ridge extending from a surface. The plastic tab is located at a cutout region at the lip of the container. The tab has the shape of a half moon. The removable film is more flexible than the walls of the formed plastic container. The film is adhered to the container with a removal force greater than 1.5 Newtons (preferably 3–5 Newtons). The film carries printing on an internal surface between film layers. The film is heat sealed or radio frequency (RF) sealed to the sealing surface of the container.

In another aspect, the invention features, in general, a package component including a formed plastic container defining a storage region and a sealing surface around an entrance to the region, a plastic tab that is adjacent to the sealing surface, and a temporary connector that connects the tab to the plastic container.

Particular embodiments of the package component may have one or more of the following features. The temporary connector has a first portion that extends transversely from a tab edge, a second portion that extends from the first portion generally parallel to the container edge and the tab edge, and a third portion that extends transversely from the container edge to the second portion, resulting in a hoop shape connector. The temporary connector is molded at the same time as the formed plastic container and the tab. Alternatively, the temporary connector could be a frangible bridge portion of plastic.

In other aspects, the invention features, in general, methods of making the sealed packages as described and methods of using the sealed packages as described.

Embodiments of the invention may include one or more of the following advantages. The sealed package protects the cartridge from moisture, shaving preparation products such as soaps, foams and gels, and cleaning agents when the package is stored in a shower or bath tub area prior to usage. The hoop bridge members can be easily severed with a single cut along the outside of the package. The inclined surfaces guide the cartridge to the desired position when loaded into the storage region. The support members and retaining structure hold the cartridge in a desired position for attachment to a handle. The plastic tabs provide a good gripping member for initiating peeling. The deadfold characteristics prevent a partially removed foil from interfering with connection of the handle to the cartridge. The ramp structure guides the handle to the connecting portion of the cartridge contained in the container. The lip protects the user's fingers or thumb from the cutting edges of the blade during removal of the cartridge from the container.

Other advantages and features of the invention will be apparent from the following detailed description of the embodiments of the invention and from the claims.

BRIEF DESCRIPTION OF THE DRAWINGS

FIG. 12 shows the layered structure of the removable film of the FIG. 1 package.

FIGS. 13–14 shows a handle being connected to a razor cartridge contained in the FIG. 1 package.

DETAILED DESCRIPTION OF EMBODIMENTS OF THE INVENTION

Figure 1:
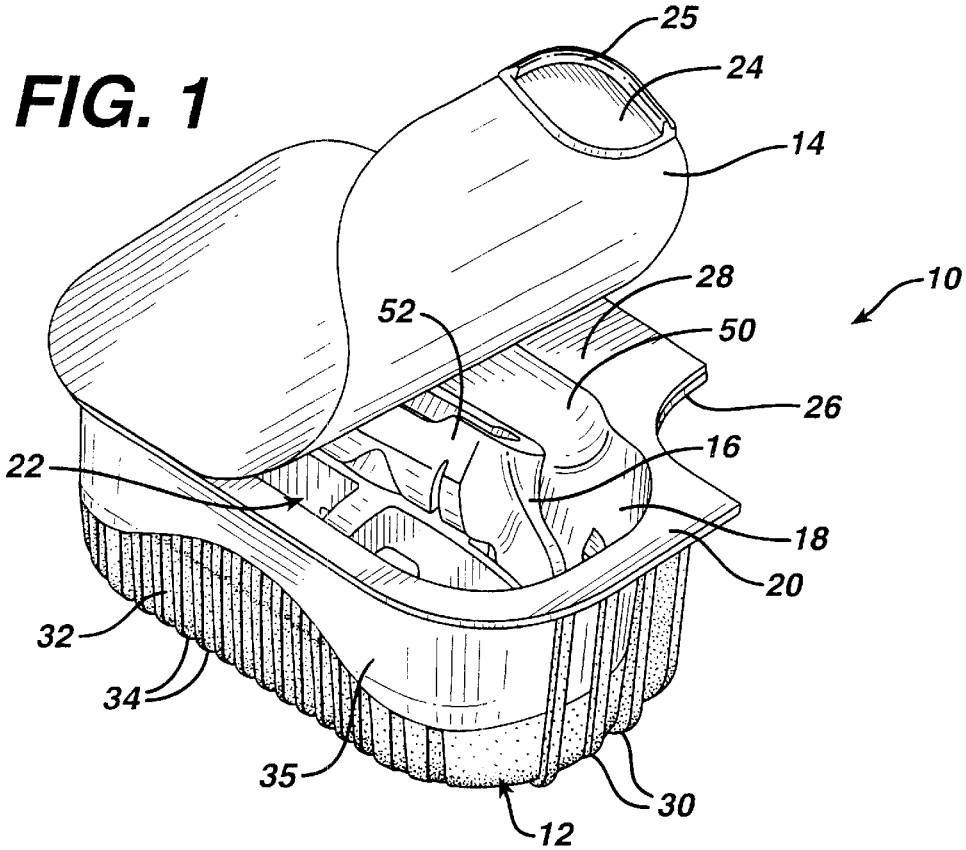
FIG. 1 is a perspective view of a sealed package in a partially opened condition with a shaving cartridge in the package.
Figure 2:
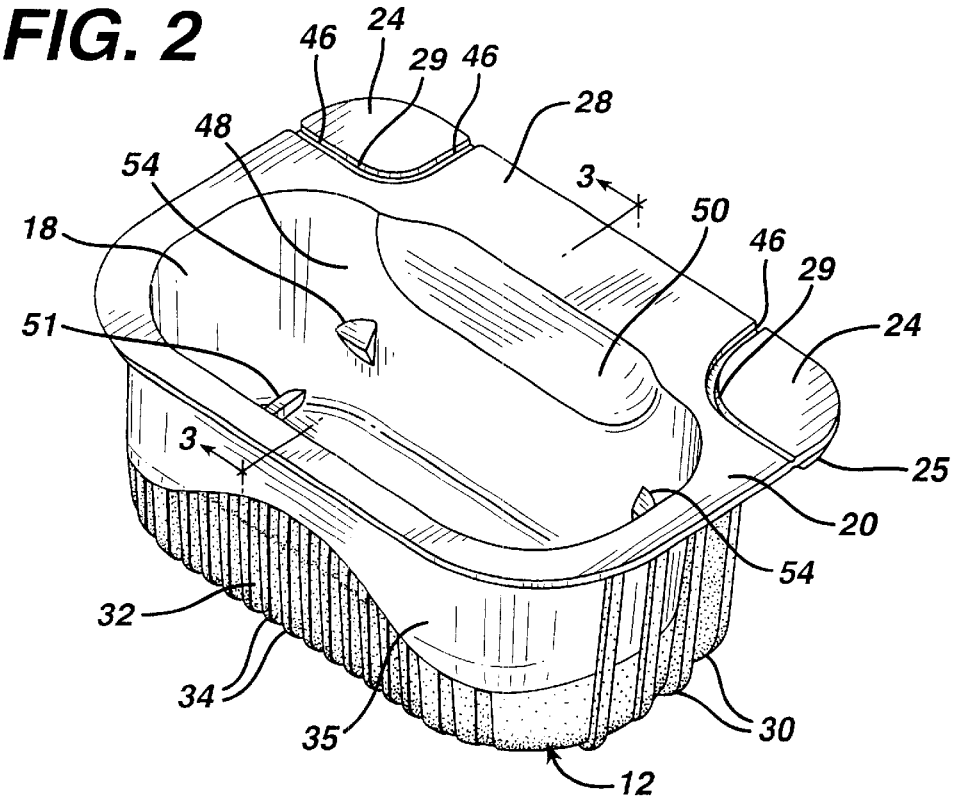
FIG. 2 is a perspective view of a formed plastic container of the FIG. 1 package.

Referring to FIG. 1 there is shown sealed package 10 including formed plastic container 12, cover sheet 14, and shaving cartridge 16 stored inside container 12 in storage region 18. FIG. 2 shows container 12 prior to attachment of cover sheet 14. Container 12 has a sealing surface 20 surrounding the entrance 22 to storage region 18, and cover sheet 14 is sealed to sealing surface 20. Plastic tabs 24 (only one is shown in FIG. 1) are attached to an undersurface at two corners of cover sheet 14. Plastic tabs 24 are used to initiate peeling of sheet 14. Prior to peeling, plastic tabs 24 are located in cutaway portions 26 (FIG. 1) that are located at the ends of lip 28, which extends along one side of container 12. As can be seen from FIG. 2, there is a curved gap 29 between tab 24 and lip 28.

Figure 4:
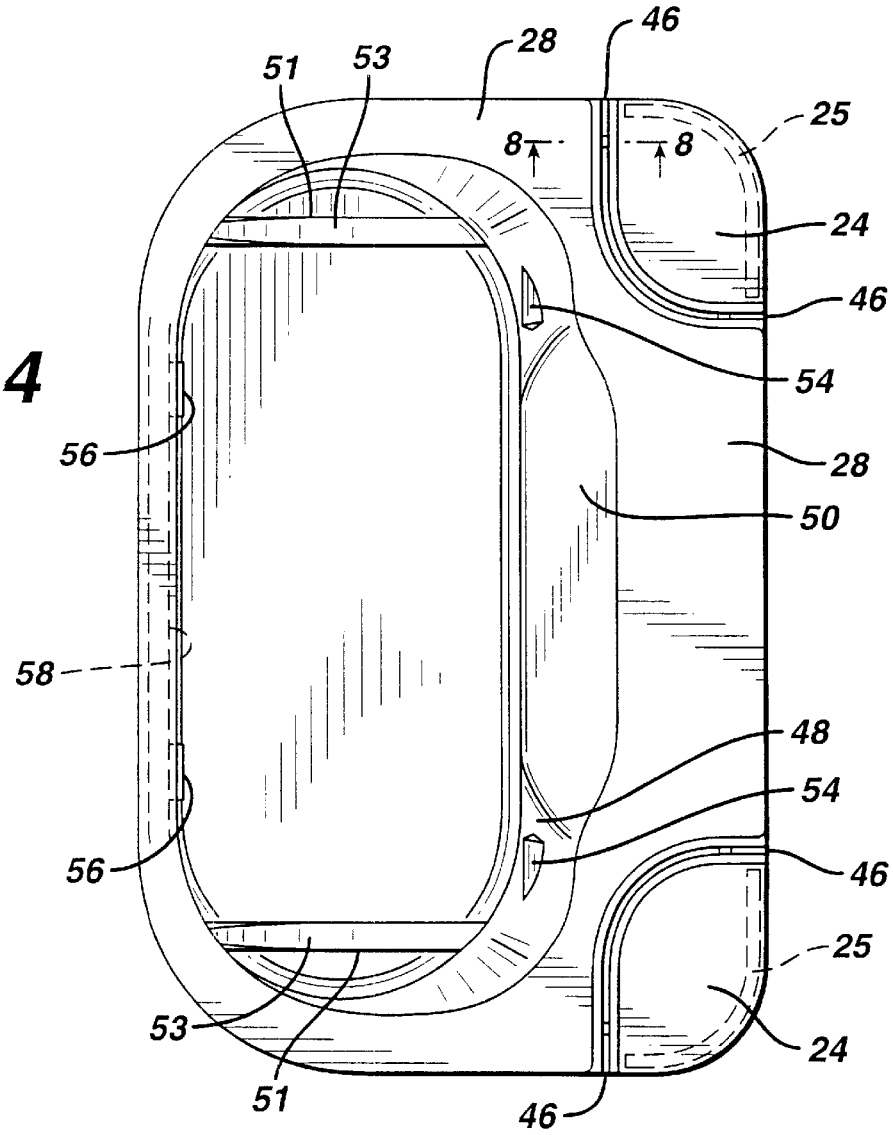
FIG. 4 is a top view of the FIG. 2 plastic container.
Figure 5:
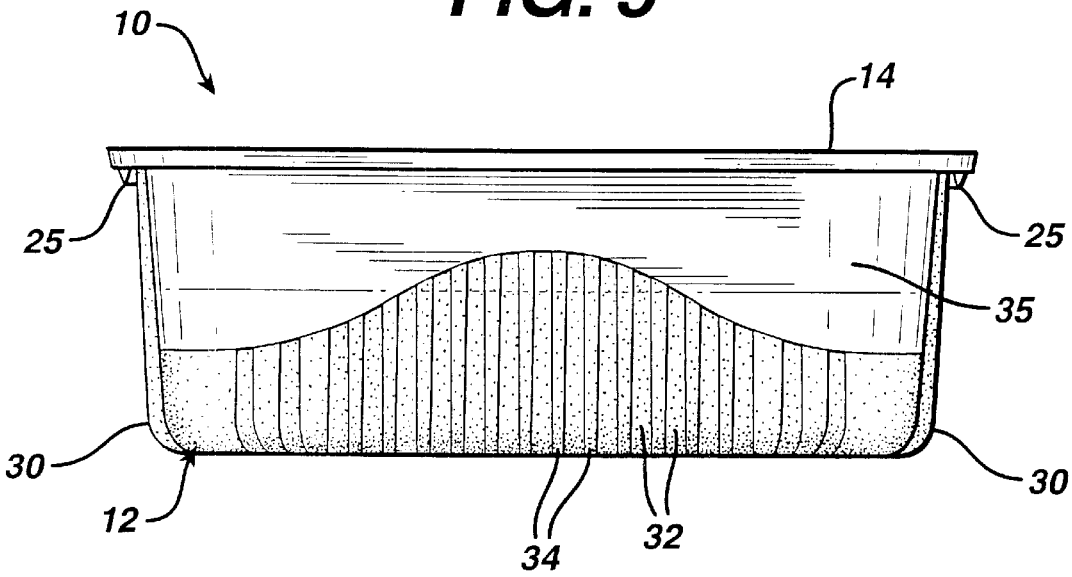
FIG. 5 is a front elevation of the FIG. 2 plastic container.
Figure 6:
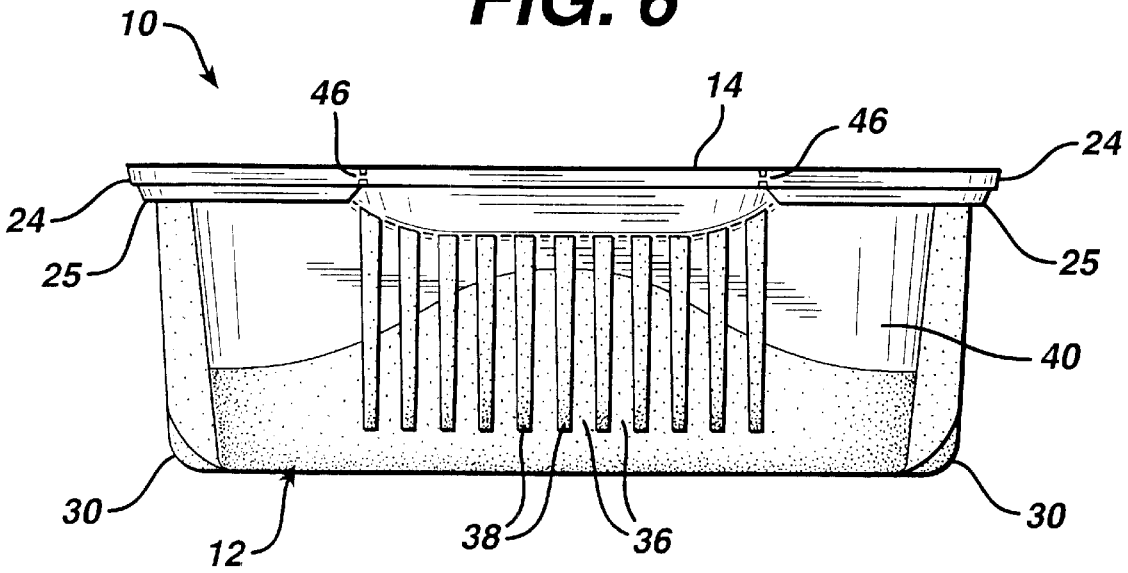
FIG. 6 is a rear elevation of the FIG. 2 plastic container.
Figure 7:
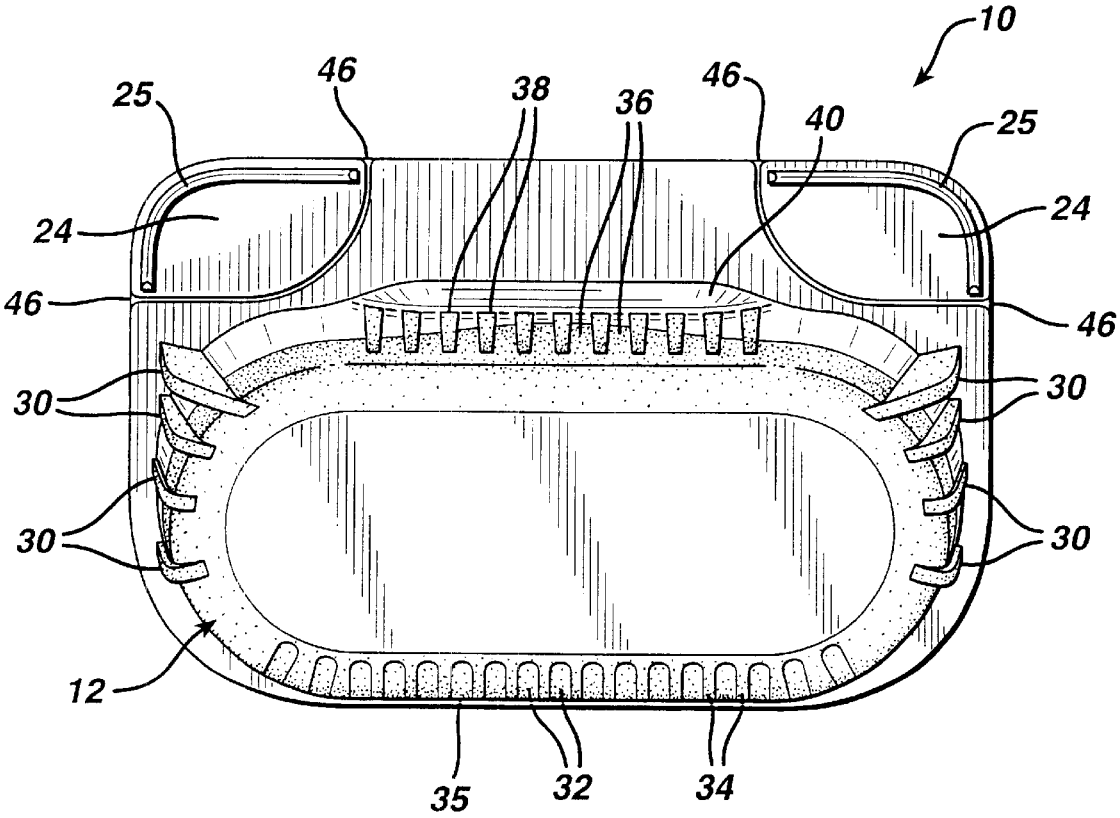
FIG. 7 is a bottom view of the FIG. 2 plastic container.

Referring to FIGS. 1 through 7, container 12 has finger gripping ridges 30 on the two ends (FIGS. 1, 2 and 7) and relieved portions 32 providing vertical gripping portions 34 on front surface 35 (FIGS. 1, 2, 5 and 7) and relieved portions 36 providing gripping ridges 38 on rear surface 40 (FIGS. 6 and 7). As can perhaps best be seen from the bottom view in FIG. 7, the end gripping ridges 30 extend further outward than the middle gripping ridges 30 such that the outermost surfaces of the gripping ridges have an overall indented profile to better accommodate the user's fingers.

Figure 8:
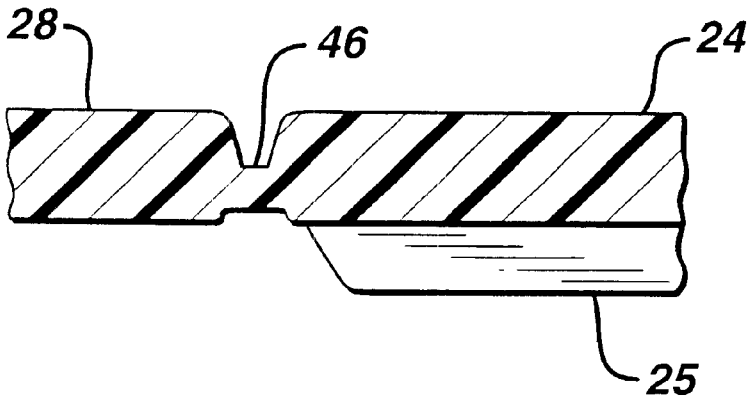
FIG. 8 is a partial sectional view, taken at 8—8 of FIG. 4, showing a connecting bridge structure of the FIG. 4 container.

FIGS. 2 and 4 show a plastic container 12 prior to filling with shaving cartridge 16 and sealing sheet 14 thereover. At this stage in the manufacture, plastic tabs 24 are part of container 12 and connected thereto by internal bridge members 46, which are best shown in FIGS. 4 and 8. Bridge members 46 are thin, frangible members that are strong enough to hold tabs 24 in place during handling prior to sealing, but weak enough to easily break when a user lifts a tab 24 to initiate peeling of cover 14. (The lips could be relieved mechanically or at least partially severed to provide alternative bridge members.) Tabs 24 have circumferential ridges 25 at the outer edges to facilitate gripping by a user's finger. (FIGS. 5, 6 and 7).

Referring to FIGS. 1–4, it is seen that lip 28 is connected to side wall 48 of the container by an angled ramp structure 50 that leads to cartridge connecting structure 52 (FIG. 1) of cartridge 16. A suitable cartridge 16 is described in U.S. Ser. No. 09/066,499, filed Apr. 24, 1998, U.S. Pat. No. 6,161, 287, (see corresponding published PCT application WO 99/55499, published Nov. 4, 1999). U.S. Design Patent D407,851 describes a handle that mates with cartridge 16. During connection of a razor handle (FIG. 13) to cartridge 16, the connecting end of the handle is brought over lip 28, and ramp 50 tends to guide the end of the handle into connecting structure 52 (FIG. 1). Upon connection of cartridge 16, the handle is retracted, and cartridge 16 is removed from container 12. Lip 28 protects the user's thumb and fingers from being cut by the blades of cartridge 16 during retraction from container 12.

Figure 3:
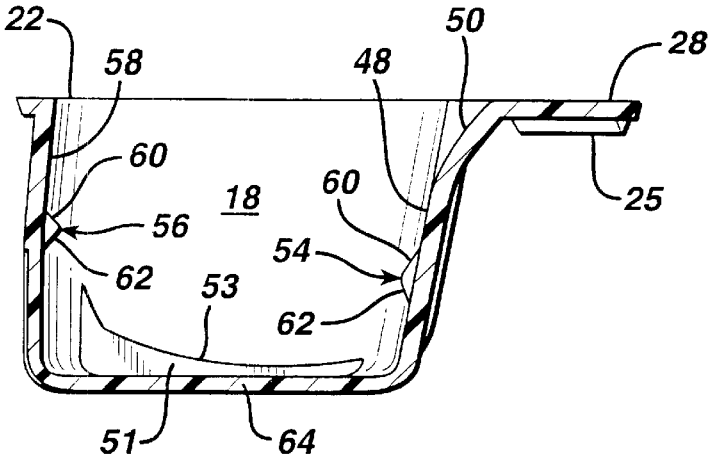
FIG. 3 is an sectional view, taken at 3—3 of FIG. 2, of the FIG. 2 plastic container.

Referring to FIGS. 3 and 4 it is seen that container 12 has two supporting members 51, which have curved, concave upper surfaces 53 matching the profile of the top surface of the blade unit of cartridge 16 in order to support cartridge 16 in the desired position. Supporting members 51 support the edge portions of cartridge 16 outside of the blades of cartridge 16. When stored in container 12, the cutting edges of the blades face downward. Detents 54, 56 protrude inward from respective side walls 48, 58. Both detents 54, 56 have upper inclined surfaces 60 facing entrance 22 and lower inclined surfaces 62 facing bottom wall 64. As the cartridge is loaded into container 12, the cartridge slightly deforms the container walls as it moves over inclined surfaces 60 and snaps past detents 54, 56. The cartridge also slightly deforms the container walls as the cartridge moves past inclined surfaces 62 during removal from the container 12. Detents 54 hold the guard portion of cartridge 16 down, and detents 56 hold the cap portion of the razor cartridge down.

In manufacture, container 12 is injection molded from polypropylene. Other materials that can be use for container 12 include polystyrene (particularly crystalline polystyrene, high impact polystyrene (HIPS) or medium impact polystyrene (MIPS)), polycarbonate, acrylonitrile butadiene styrene (ABS), Nylon, and SAN. In using materials other than polypropylene, one skilled in the art would select an appropriate sealing layer material for sealing layer 118 (shown in FIG. 12 and discussed below). After forming container 12, a cartridge 16 is loaded into a container 12 with the blade unit snapping beyond detents 54, 56 and resting on upper surface 53 in a desired connecting position with cartridge connecting structure 52 adjacent to ramp 50 near lip 28. Then cover sheet 14 is sealed to upper sealing surface 20 and to the upper surfaces of plastic tabs 24 by heat welding. Alternatively, radio frequency sealing could be employed.

Container 12 is made from transparent plastic to permit visual inspection of the cartridges therein. Cover sheet 14 is printable, and can carry instructions for opening and use of a cartridge. Cover sheet 14 is made of a laminate as shown in FIG. 5 (not to scale). The laminate comprises 0.48 mil thick (0.012 mm, 48 gauge) PET upper layer 112 (which is reverse printed), 0.50 mil thick (0.013 mm, 50 gauge, alternatively referred to as "7.5 lbs./ream") polyethylene (preferably LDPE) layer 114 thereunder (which is preferably white for opacity, but could alternatively be transparent), 1.15 mil thick (0.029 mm, 115 gauge) oriented high density polyethylene layer (HDPE) 116 thereunder, 0.1 mil thick (approximately) (also referred to as about "2 lbs./ream") polyester-urethane adhesive layer 117 thereunder, and 1.25 mil thick (0.32 mm) coextruded LDPE-EVA(28%) lower sealing layer 118 thereunder, the lower EVA portion of which heat bonds to container 12.

In sheet 14, the HDPE layer, and to a lesser extent the LDPE layer, provide moisture barrier properties and deadfold characteristics. PET provides bulk and clarity and protection for the printing on its lower surface. PET also provides structural integrity for the laminate so as to avoid tearing and provide one-piece removal of the laminate. PET is selected that preferably withstands an accelerated testing regime of a 100° F. hot water bath for 24 hours without delamination. The polyethylene layer (preferably LDPE) acts as a bonding layer to join the HDPE layer and the PET layer. The PET is chemically primed for use with the LDPE which is applied hot (about 600° F.) as the bonding layer between PET and HDPE. The polyethylene layer (preferably LDPE) is preferably opaque, in particular white, to provide a background color for the printing, and provides opacity to present an aesthetically more uniform appearance between regions that are heat-affected by sealing and those regions further from the sealing surface. The polyester-urethane layer 117, which is very thin and less than 1 mil, preferably only about 0.1 mil, acts as a bonding layer to join the HDPE layer 116 and the LDPE-EVA sealing layer 118. The LDPE-EVA of layer 118 is particularly suited for providing a seal to polypropylene in container 12. It is understood that the amount of EVA in the sealing layer 118 can be varied depending on the material of container 12. It is further understood that if using radio frequency or ultrasonic sealing, it would be possible to omit a distinct lower sealing layer 118. The sealing layer 118 is preferably not thicker than 1.25 mil or else its bulk may outstrip the deadfold capability of the HDPE layer to remain peeled back.

Figure 15:
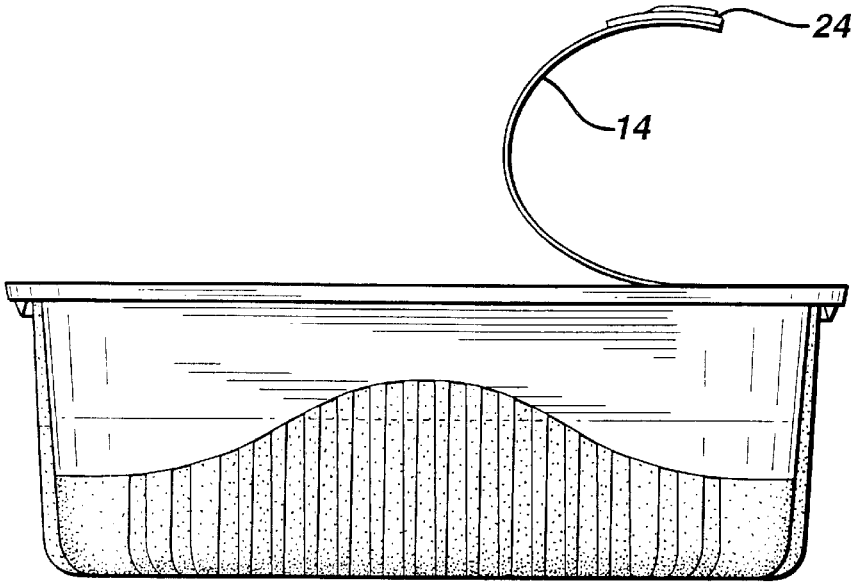
FIG. 15 shows an opened cover sheet of the FIG. 3 package remaining in a stable first exemplary peeled back condition.
Figure 16:
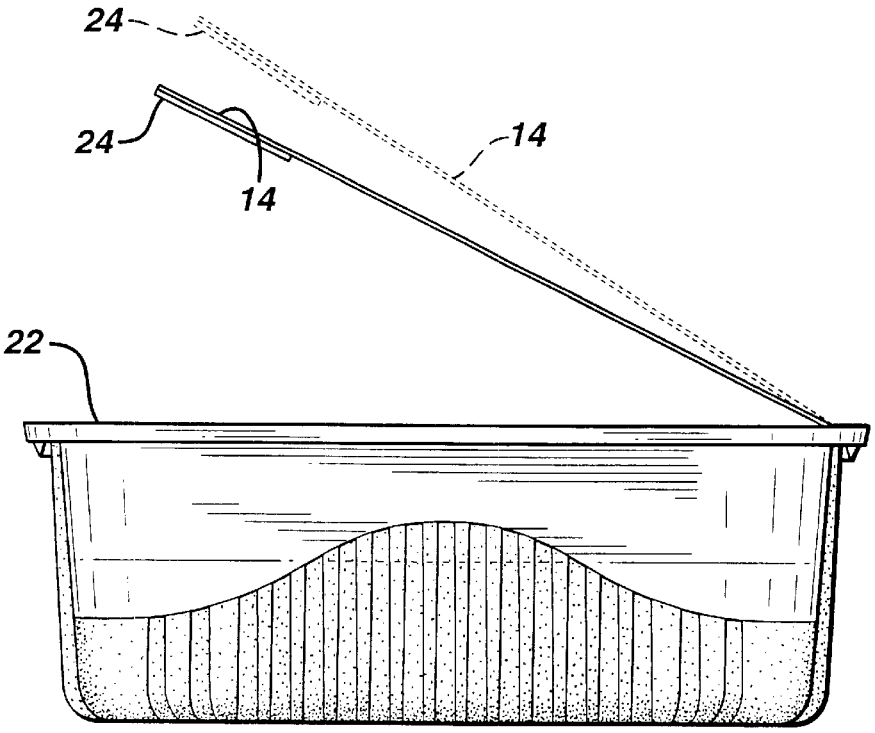
FIG. 16 shows an opened cover sheet of the FIG. 3 package remaining in a stable second exemplary peeled back condition.

"Deadfold" characteristics for the laminate are provided by the LDPE and HDPE layers, primarily the HDPE layer. The deadfold characteristics are such that when cover sheet 14 is peeled open with a portion still attached to the container 12, and then released by the user's hand, sheet 14 remains folded back or bended back after opening, as is shown in FIGS. 13–16, to permit easy access to the cartridge. In the case of stored articles that could be accessed by a user's hands, the deadfold characteristic is such that there is substantially unobstructed access to a digit of the hand while accessing the article inside. In general, as is shown in FIG. 16, sufficient deadfold results when the angle between the removed portion and sealing surface 22 is greater than 30° and most preferably greater than 45° (schematically depicted in dotted line positions). Viewed another way, as shown for example in FIG. 15 or 16, sufficient deadfold results in the removed portion of the cover sheet remaining behind a position to expose at least halfway the area of the entrance to the container to permit substantially unimpeded access to a stored object. Preferably, as is shown in FIG. 15, the removed portion of the cover sheet generally remains behind a midline through the container half-way between side surfaces. In particular, cover sheet 14 remains folded back sufficiently such that the handle is substantially unobstructed while connecting to the cartridge, and the cartridge can be removed without a substantial impediment.

The moisture vapor barrier properties are provided by the LDPE and HDPE layers, primarily the HDPE layer. The moisture barrier property of the sheet can be expressed in terms of the Moisture Vapor Transmission Rate (MVTR) being less than or equal to about 0.16 gm of water per 100 square inches per 24 hours, under conditions of 100° F. (37.8° C.) and 90% relative humidity.

The use of the HDPE layer together with the LDPE layer advantageously provides the desired combination of deadfold characteristics and moisture barrier properties. Further, the cover sheet is improved by the use of the LDPE layer being sandwiched between an outer PET layer and the HDPE layer to give the additional benefit of protecting the film integrity, such as the resistance to tearing and integrity of the printing.

The plastic sheet structure of cover 14, rather than metal foil, is preferred because it meets EAS requirements. In an EAS system, small tags (which commonly contain metal inside them) on the products are deactivated at time of payment so as to not set off an alarm when a paying customer leaves the store. If metal foil were used on a package containing a shaving cartridge, the combination of metal foil and metal blades in close proximity could interfere with proper functioning of the EAS tag.

Cover sheet 14 maintains structural integrity and does not delaminate, does not tear when being removed (i.e., is removable in one piece), and does not degrade in the presence of water and household cleaning agents (which, e.g., might be used in a bath tub) or shaving preparation products, protects articles stored therein from moisture and cleaning agents, has desired deadfold characteristics for ease of product removal, is printable, and does not interfere with EAS systems.

Cover sheet 14 is adhered to container 12 to have a predetermined initial peel force. Peel force is determined by supporting container 12 such that cover sheet 14 is in a vertical plane with the corner tab being directed downward, and a diagonal from that corner to the opposite corner being aligned vertically. Container 12 is maintained in this position by a fixture, while the tab at the lower corner is connected to a force versus distance measurement machine (available under the Instron trade designation) and pulled upward by the machine. The resulting distance versus force graph typically has a single peak, being the initial peel force of interest, of about 3–5 lb. (13.6–22.7N) at sealing temperatures from 160° C.–215° C. The preferred sealing temperature is about 175° C.

In use, a user bends plastic tabs 24 to break bridges 46 and then pulls back along the surface of the cover sheet to initiate peeling. The user can grip the gripping ridges 30 at the two ends of the container or alternatively grip the ridges 34, 38 at the front and the back. The user then connects the handle (not shown) to cartridge connecting structure 52, and removes cartridge 16. Detents 56 act as a pivot as cartridge 16 is removed. If the front and the back ridges 34, 38 are gripped by the user, lip 28 protects the user's thumb or fingers from being cut by the blades during removal of the cartridge.

Figure 9:
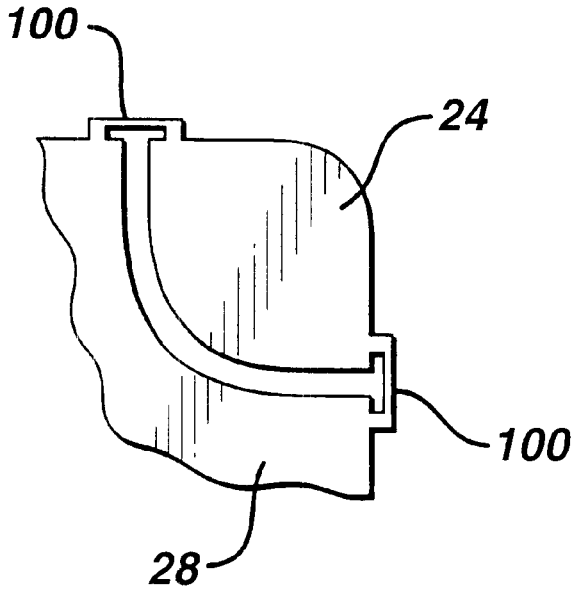
FIG. 9 is a partial plan view showing an alternative to the bridge structure.
Figure 10:
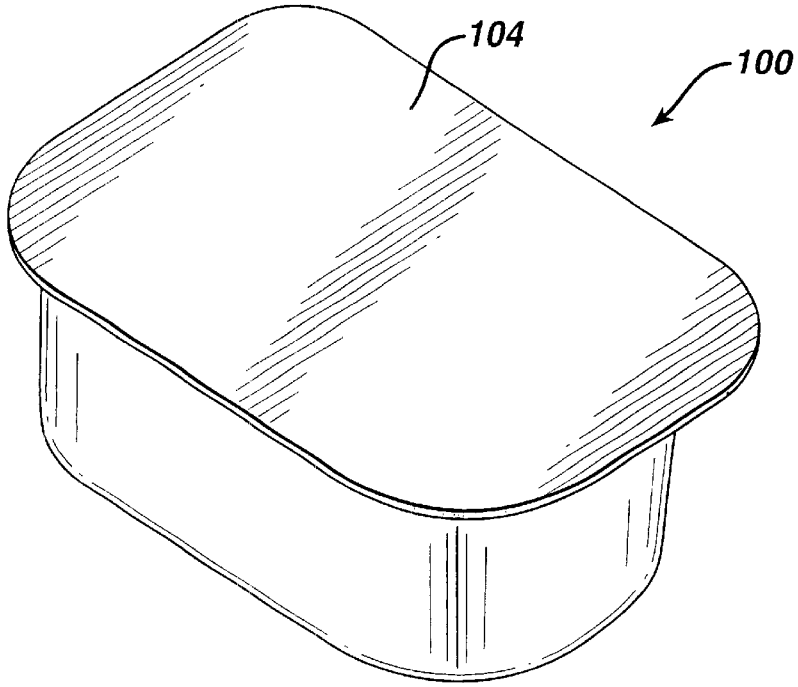
FIG. 10 PRIOR ART
FIGS. 10–11 show a prior art sealed food container.
Figure 11:
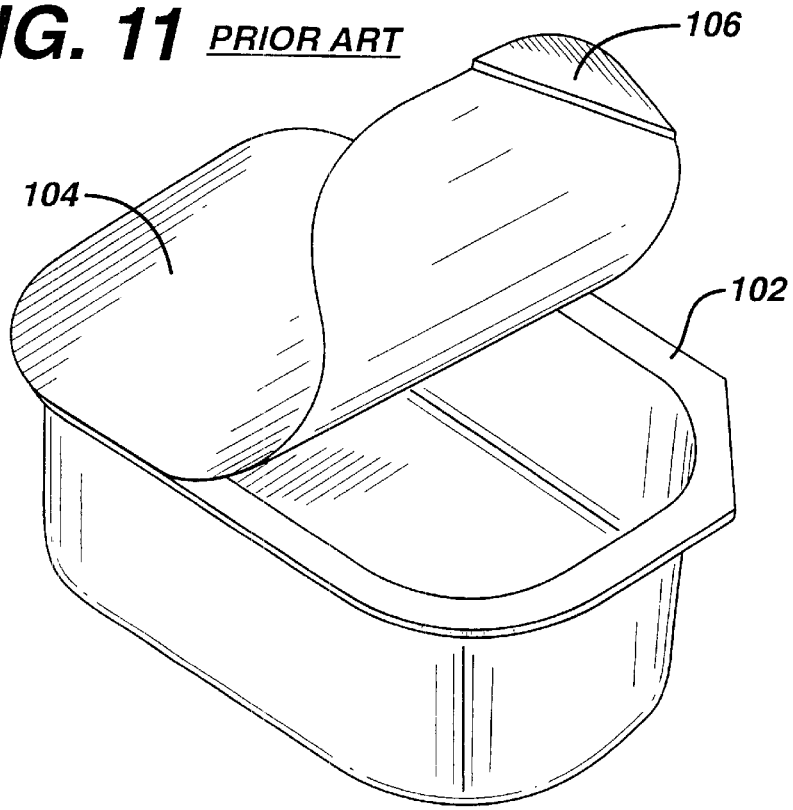
FIG. 11 PRIOR ART

Other embodiments of the invention are within the scope of the claims. For example, FIG. 9 (describing the preferred embodiment) shows the use of hoops 100 that extend outward from tabs 24 and the side of container 12 to provide a temporary connecting structure. After cover sheet has been sealed to container 12 and tabs 24, hoops 100 can each be trimmed with a single cut parallel to the sides of the container 12 or edge of lip 28. In addition, tabs 24 and container can be made from the same material or different material, and the temporary connectors, e.g., hoops 100, could be made of the same or different material. Tabs could be made of elastomeric material to provide a better grip surface. Besides angled detents 54, 56, other protruding structure could be used to hold a cartridge in a desired position. Cover sheet 14 could, in some applications, be made of metal foil, which will have the desired deadfold characteristics.

Listing of Reference Numerals sealed package 10
formed plastic container 12
cover sheet 14
shaving cartridge 16
storage region 18
sealing surface 20
entrance 22
plastic tabs 24
circumferential ridges 25
cutaway portions 26
lip 28
curved gap 29
finger gripping ridges 30
relieved portions 32
vertical gripping portions 34
front surface 35
relieved portions 36
gripping ridges 38
rear surface 40
internal bridge members 46
side wall 48
angled ramp structure 50
supporting members 51
cartridge connecting structure 52
concave upper surfaces 53
detents 54, 56
upper inclined surfaces 60
lower inclined surfaces 62
bottom wall 64
hoops 100
plastic container 101
rim 102
plastic covering film 104
pull tab 106

What is claimed is:

1. A package component comprising a formed plastic container defining a storage region, a container edge, and a sealing surface around an entrance to said region, a plastic tab that is adjacent to said sealing surface and has a tab edge that is adjacent said container edge, and a first temporary connector that connects said tab to said plastic container, and wherein said first temporary connector has a first portion that extends transversely from said tab edge, a second portion that extends from said first portion generally parallel to said container edge and said tab edge, and a third portion that extends transversely from said container edge to said second portion, whereby said first temporary connector can be trimmed by a single cut made parallel to said container edge.

2. The package component of claim 1 wherein said tab edge is in line with said container edge.

3. The package component of claim 1 or 2 wherein said temporary connector is molded at the same time as said formed plastic container and said tab.

4. The package component of claim 1 wherein said container has a bottom wall and side walls extending upward from said bottom wall and defining said storage region, and further comprising a lip adjacent to and extending from a first said side wall at said entrance, said lip having a cutout portion at an end of said lip, and wherein said tab is located at said cutout portion.

5. The package of claim 4 wherein said tab has a first tab edge that is in line with a lip edge, and a second tab edge that is transverse to said first tab edge and is in line with a container edge at a second said side wall that is adjacent to and transverse to said first side wall.

6. The package of claim 5 further comprising a second temporary connector that connects said tab to said plastic container.

7. The package of claim 6 wherein said second temporary connector has a first portion that extends transversely from said second tab edge, a second portion that extends from said first portion generally parallel to said container edge and said second tab edge, and a third portion that extends transversely from said container edge to said second portion, whereby said first and second temporary connectors can be trimmed by respective single cuts parallel to said lip edge and said container edge.

8. The package component of claim 7 wherein said first and second temporary connectors are molded at the same time as said formed plastic container and said tab.

9. The package component of claim 1 wherein said temporary connector is a frangible bridge portion of plastic.

10. The package component of claim 9 wherein there is an interface between said tab and said container, and said frangible bridge portion is at a discrete location along said interface.

11. The package component of claim 9 wherein there is an interface between said tab and said container, and said frangible bridge portion extends along at least a majority of said interface.

12. The package component of claim 1 wherein said temporary connector and tab are of a different material than said container, and wherein said container, tab, and temporary connector are provided by two-component molding.

13. The package component of claim 1 further comprising a removable film that is sealed to said sealing surface and covers said entrance, said film also being secured to said tab.

14. The package component of claim 13 wherein said film is secured to said tab by sealing to said tab during the same operation in which said film is sealed to said sealing surface.

15. The package component of claim 1 wherein said container has a plurality of protruding finger gripping ridges on one or more exterior surfaces.

16. The package component of claim 1 wherein said container has a plurality of protruding finger gripping ridges on one or more exterior surfaces, said ridges having an indented profile to accommodate a user's fingers.

17. The package component of claim 1 wherein said tab has a gripping ridge extending from a surface.

18. The package component of claim 5 wherein said container is sized to store a shaving cartridge and includes a ramp structure connecting said lip to a said side wall and leading to said cartridge in said region.

* * * * *